US010570837B2

(12) United States Patent
Winiecki

(10) Patent No.: US 10,570,837 B2
(45) **Date of Patent: *Feb. 25, 2020**

(54) METHOD OF CALCULATING AVERAGE REVOLUTIONS PER INDEPENDENT UNIT WITH A GPS NAVIGATION SYSTEM

(71) Applicant: Kenneth Carl Steffen Winiecki, Cupertino, CA (US)

(72) Inventor: Kenneth Carl Steffen Winiecki, Cupertino, CA (US)

( * ) Notice: Subject to any disclaimer, the term of this patent is extended or adjusted under 35 U.S.C. 154(b) by 149 days.

This patent is subject to a terminal disclaimer.

(21) Appl. No.: 15/481,230

(22) Filed: Apr. 6, 2017

(65) Prior Publication Data

US 2017/0211492 A1 Jul. 27, 2017

Related U.S. Application Data

(63) Continuation of application No. PCT/US2015/038644, filed on Jun. 30, 2015, and a continuation-in-part of application No. PCT/IB2016/052611, filed on May 6, 2016, and a continuation-in-part of application No. 15/481,193, filed on Apr. 6, 2017, now abandoned, said application No. PCT/IB2016/052611 is a continuation of application No. 14/507,221, filed on Oct. 6, 2014, now Pat. No. 9,008,947.

(60) Provisional application No. 62/399,874, filed on Sep. 26, 2016, provisional application No. 61/951,381, filed on Mar. 11, 2014.

(51) Int. Cl.

| | |
|---|---|
| ***F02D 41/00*** | (2006.01) |
| ***F02D 41/02*** | (2006.01) |
| ***G07C 5/08*** | (2006.01) |
| ***G07C 5/12*** | (2006.01) |
| ***F02D 41/22*** | (2006.01) |

(52) U.S. Cl.

CPC ..... *F02D 41/0097* (2013.01); *F02D 41/22* (2013.01); *G07C 5/085* (2013.01); *G07C 5/12* (2013.01); *F02D 2041/228* (2013.01); *F02D 2200/701* (2013.01)

(58) Field of Classification Search

None

See application file for complete search history.

(56) References Cited

U.S. PATENT DOCUMENTS

2013/0291629 A1* 11/2013 Falzarano ..... B60K 37/02 73/114.01

* cited by examiner

*Primary Examiner* — Abdhesh K Jha

(57) ABSTRACT

A method to obtain average revolutions per independent unit includes a total number of engine revolutions with an on-board computing device and a current distance value with the on-board computing device and a retrofitted global positioning system unit so that a final value can be calculated by dividing the total number of engine revolutions with the current distance value for a designated time period. The current distance value can be a distance unit or time unit as the final value, which is the average revolutions per independent unit, is displayed with a control panel of a vehicle. The final value provides an accurate conclusion regarding the current condition of an engine in addition to the accuracy mileage of the engine or the engine hours.

6 Claims, 7 Drawing Sheets

METHOD OF CALCULATING AVERAGE REVOLUTIONS PER INDEPENDENT UNIT WITH A GPS NAVIGATION SYSTEM

The current application claims benefit of provisional application No. 62/399,874 filed Sep. 26, 2016, and is a continuation of PCT/US15/038644 filed Jun. 30, 2015, and is a continuation in part of PCT/IB2016/052611 filed May 6, 2016. PCT/IB2016/052611 is a continuation of U.S. Ser. No. 14/507,221 filed Jun. 10, 2014 which claims benefit of provisional 61/951,381 filed Mar. 11, 2014.

The current application is further a continuation of U.S. Ser. No. 15/481,193 filed Apr. 6, 2017.

FIELD OF THE INVENTION

The present invention relates generally to the field of vehicles. More specifically, the present invention is a method that divides the total number of revolutions on an engine by an independent unit so that a reading can be obtained in which provides an accurate explanation about the engine condition in relation to a distance unit or a time unit.

BACKGROUND OF THE INVENTION

Used vehicles are valued via several variables including, but not limited to, the interior condition, exterior condition, model, production year, and mileage. Even though different variables are utilized to calculate the monetary value of used vehicles, the mileage of used vehicles is considered to the most important aspect during the pricing process as the mileage is directly related to the mechanical condition of the engine. However, the relationship between the mileage and the condition of the engine can be misleading in some instances. For example, some older high mileage cars may have engines that have been well maintained and revved with low engine revolutions while some older low mileage cars may have engines that have been abused and revved with high engine revolutions. Normally a buyer would purchase the low mileage car assuming it has the better engine compared to the high mileage car. In relation to the example, the low mileage car has the worse conditioned engine compared to the engine of the high mileage car. This provides a real challenge for used car buyers because they cannot find out the how the engine of a particular used car is cared for by the previous owner.

It is an object of the present invention to introduce a method to obtain average revolutions per independent unit so that the buyer can value the used vehicle from both the mileage and the average revolutions per independent unit. The present invention takes into consideration the number of total revolutions of the engine and the total distance traveled by the vehicle or the total runtime of the engine through the GPS navigation system so that the average revolutions per independent unit can be calculated. Resulting data of the present invention can be optionally displayed within the control panel of the vehicle as the resulting data provides valuable information not only for buyers but also for car dealers, car rental places, insurance companies, and many other similar vehicle related entities.

DETAIL DESCRIPTIONS OF THE INVENTION

All illustrations of the drawings are for the purpose of describing selected versions of the present invention and are not intended to limit the scope of the present invention.

Figure 1:
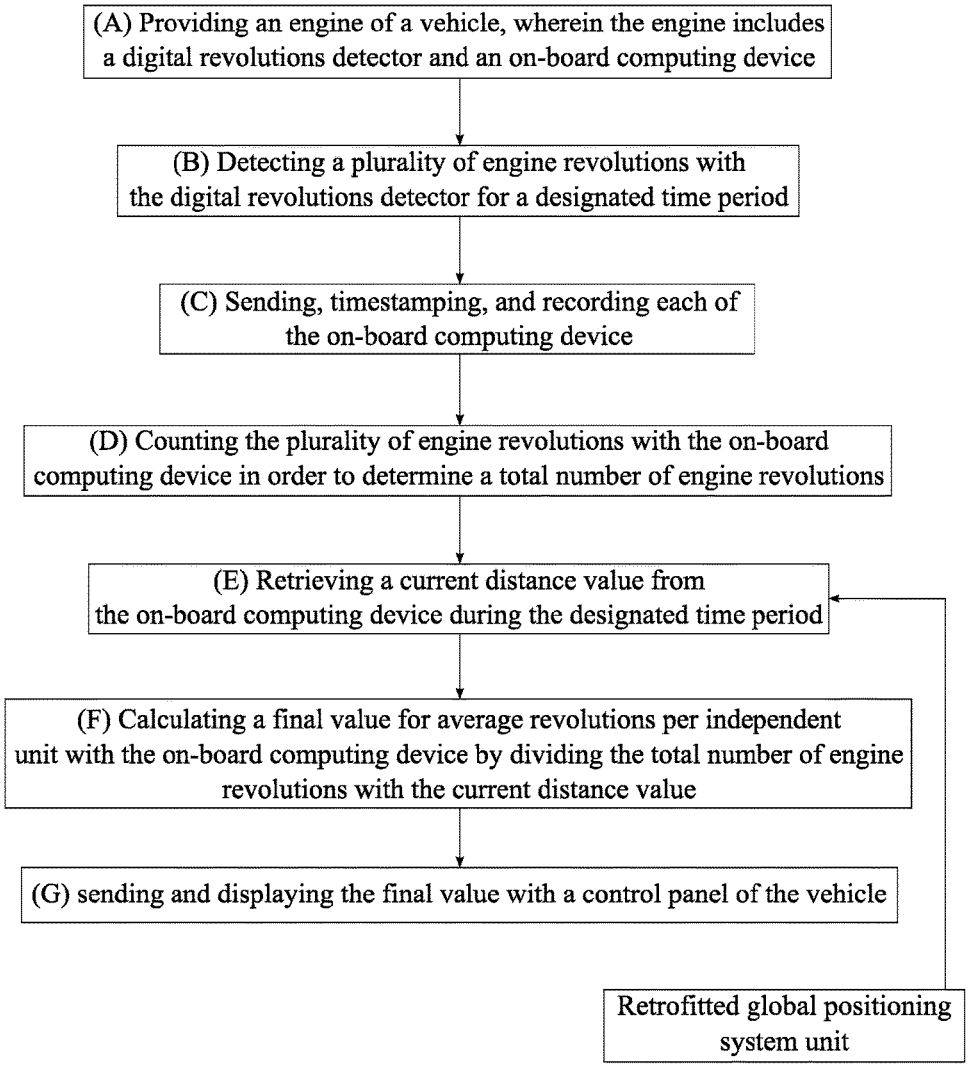
FIG. 1 is a basic flow chart illustrating the overall method of the present invention.

In reference to FIG. 1, the present invention is a method of calculating average revolutions per independent unit in a vehicle. The numerical value of the average revolutions per independent unit is displayed through a control panel of a vehicle as the independent unit of the present invention can be either a distance unit or a time unit. The present invention provides an additional variable regarding the condition of an engine of the vehicle so that the users of the present invention are able to determine the condition of the engine in relation to the driving styles of the previous users. Knowing how the engine is revved by the previous users provides an accurate conclusion about the engine in addition to the mileage of the engine or the engine hours. In order for the present invention to function, the engine is required to electronically connect with a digital revolutions detector and an on-board computing device.

The digital revolutions detector detects a plurality of engine revolutions of the engine for a designated time period, wherein the designated time period can be lifetime of the engine and a trip time. Depending upon the configuration and requirements of the present invention, the digital revolutions detector can be set for a minute, a second, a centisecond, or a millisecond. Since the on-board computing device and the digital revolutions detector are electronically connected with each other, the digital revolutions detector is able send the plurality of engine revolutions to the on-board computing device, wherein the digital revolutions detector of the present invention can be either a crankshaft sensor, a hall effect sensor, an inductive pickup clams assembly, or a camshaft speed sensor. Once the on-board computing device receives the plurality of engine revolutions, the on-board computing device timestamps and records each of the plurality of engine revolutions. In other words, each timestamp within the on-board computing device represents a single engine revolution of the plurality of engine revolutions so that the on-board computing device is able to determine the duration of each engine revolutions, exact date of each engine revolutions, and exact time of each engine revolutions. Then the on-board computing device counts the plurality of engine revolutions in order to determine a total number of engine revolutions for the present invention. More specifically, the total number of engine revolutions is considered to be zero for an engine that has not been fired for the first time. However, once an engine has been fired, each of the plurality of engine revolutions is counted and added into the total number of engine revolutions. Every time the engine completes the single engine revolution, the respective single engine revolution is added into the total number of engine revolutions. As a result, the total number of engine revolutions always increases within the present invention.

The on-board computing device also retrieves a current distance value, which normally displays through an odometer of the control panel, during the designated time period in order to calculate the average revolutions per independent unit. However, since some vehicles are not equipped with an odometer, the current distance value is retrieved from a retrofitted global positioning system (GPS) unit of the vehicle. Then the on-board computing device calculates a final value for the average revolutions per independent unit by dividing the total number of engine revolutions with the current distance value. Then the final value is sent and displayed with the control panel.

Figure 4:
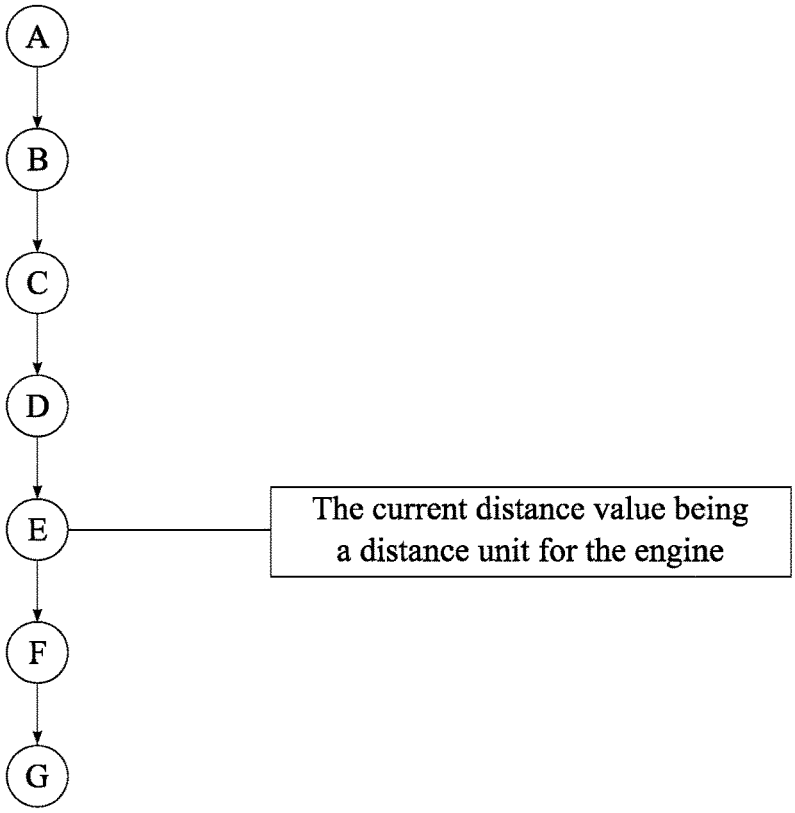
FIG. 4 is a basic flow chart illustrating the overall method of the present invention, wherein the current distance value is a distance unit.

In reference to FIG. 1 and FIG. 4, when the current distance value of the vehicle is the distance unit, the current distance value illustrates the total distance that the vehicle has been traveled up into that instant. Then the on-board computing device calculates the final value for the average revolutions per distance unit by dividing the total number of engine revolutions with the current distance value. Then the final value is sent and displayed with the control panel. The final value that is obtained through the present invention and the current distance value, which is the total distance that the vehicle has been traveled, provide an accurate conclusion about the condition of the engine with respect to the distance unit.

Figure 5:
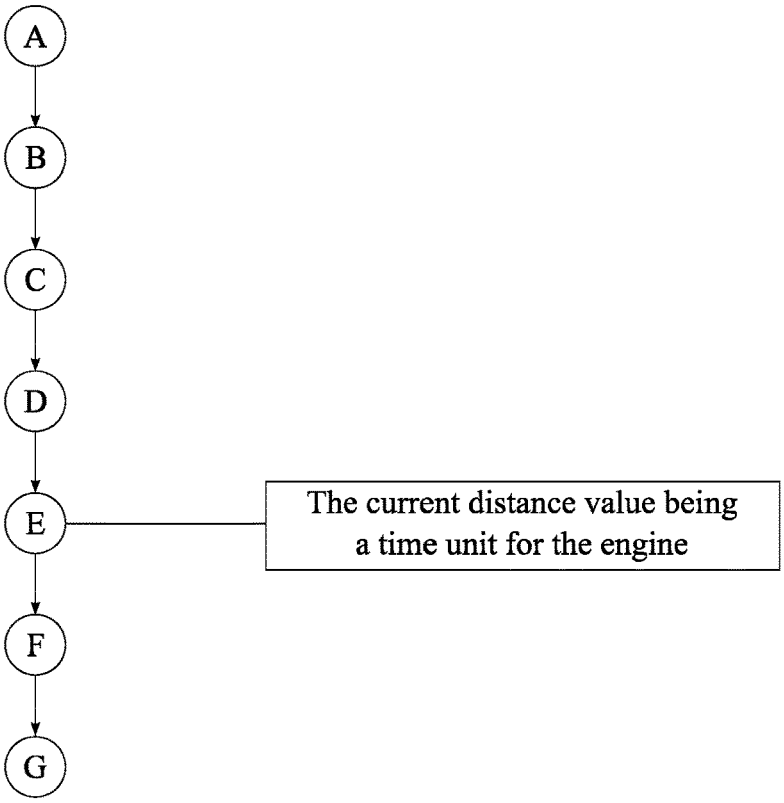
FIG. 5 is a basic flow chart illustrating the overall method of the present invention, wherein the current distance value is a time unit.

In reference to FIG. 1 and FIG. 5, when the current distance value of the vehicle is the time unit, the current distance value illustrates the total time that the vehicle has been operated up into that instant. Then the on-board computing device calculates the final value for the average revolutions per time unit by dividing the total number of engine revolutions with the current distance value. Then the final value is sent and displayed with the control panel. The final value that is obtained through the present invention and the current distance value, which is the total time that the vehicle has been operated, provide an accurate conclusion about the condition of the engine with respect to the time unit.

Following is an example how the present invention can be implemented to determine the condition of a used car engine with respect to the distance unit.

Displaying Only the Mileage:

- A buyer is looking at two similar used cars, car A and car B, wherein both used cars having the exact mileage of 2500 miles.
- Car A is $1000 cheaper than the car B.
- The buyer purchases car A since car A has the lower selling price compare to car B.

Displaying the Mileage and the Final Value:

- A buyer is looking at two similar used cars, car A and car B, wherein both used cars having the exact mileage of 2500 miles.
- Car A is $1000 cheaper than the car B.
- Car A displays a final value of 3850 and 9,625,000 of engine revolutions for the lifetime of the engine while car B displays a final value of 1900 and 4,750,000 of engine revolutions for the lifetime of the engine.
- The buyer purchases car B since car B has the lower final value compare to car A.

Conclusion:

- In the event of the buyer purchasing car A, the buyer initially saves $1000. But the buyer will be fixing or replacing the engine of car A in the near future, spending more than $1000 in repair cost.
- In the event of the buyer purchasing car B, the buyer initially spends additional $1000. But the buyer will have a dependable car without any additional repair cost.

Figure 2:
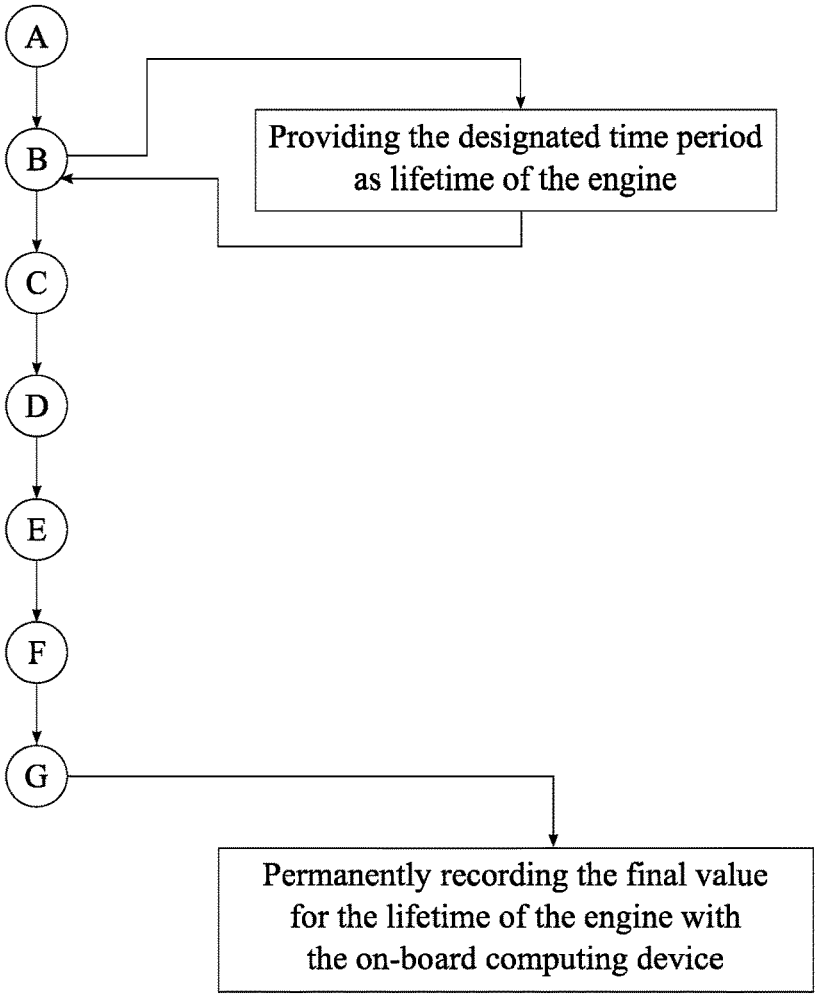
FIG. 2 is a basic flow chart illustrating the overall method of the present invention in relation to the lifetime of the engine.
Figure 3:
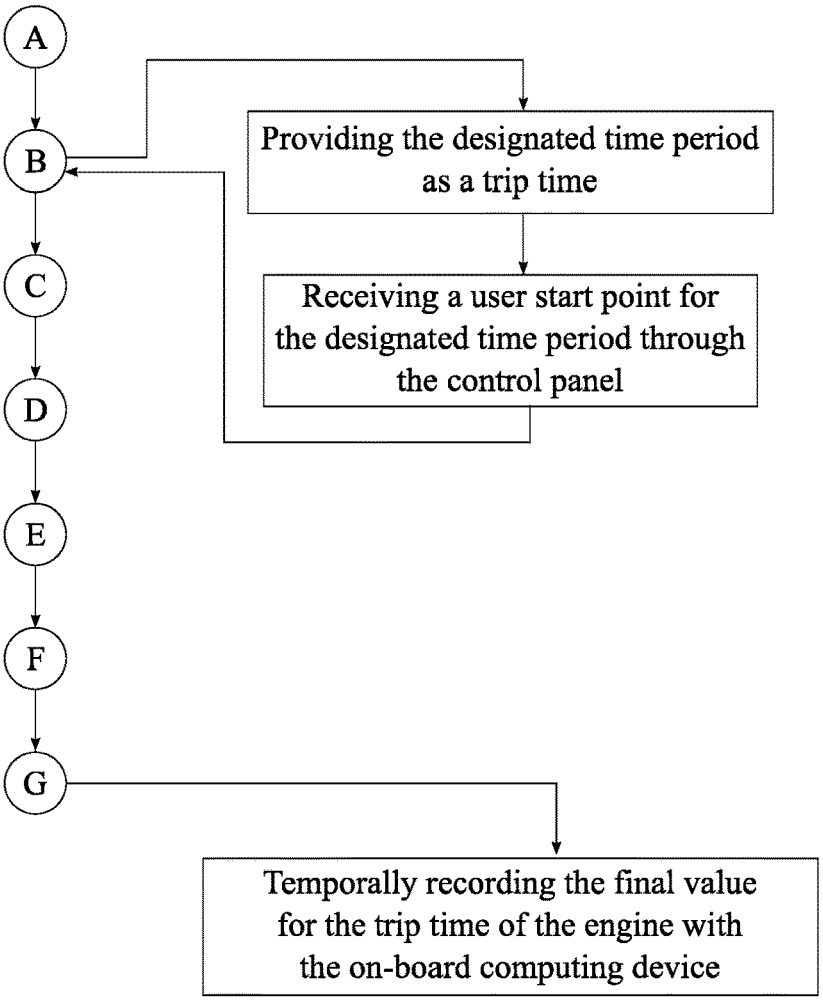
FIG. 3 is a basic flow chart illustrating the overall method of the present invention in relation to the trip time of the engine.

In reference to FIG. 2 and FIG. 3, the on-board computing device displays the final value with the control panel in regards to the two different designated time periods, which are the lifetime of the engine and the trip time. More specifically, the user of the vehicle can view the final value for both the lifetime of the engine and the trip time after viewing the total number of engine revolution and the current distance value respectively. When the designated time period is the lifetime of the engine, the on-board computing device calculates and displays the final value for the engine from a first engine revolution of the total number of engine revolutions to a final engine revolution of the total number of engine revolutions. Then the final value for the lifetime of the engine is permanently recorded with the on-board computing device. When the designated time period is the trip time, the on-board computing device calculates and displays the final value for the engine from a user start point of the total number of engine revolutions to the final engine revolution of the total number of engine revolutions. The user of the vehicle generally inputs the user start point through the control panel so that the final value can be calculated for the trip time with the on-board computing device. If the user of the vehicle does not input the user start point through the control panel, the on-board computing device automatically assigns the first engine revolution as the user start point. Additionally, the final value for the trip time is temporally recorded with the on-board computing device so that the most recent final value for the trip time can be viewed to the users of the present invention. However, every instant that the trip time is reset by the user of the vehicle, the final value for the respective trip time is stored within the on-board computing device so that the present invention is able to record how many times that the trip time is activated.

If the vehicle is equipped with an engine control unit (ECU), the ECU functions as the on-board computing device within the present invention. As a result, the ECU is able to perform all the aforementioned functionality of the on-board computing device in order to execute the present invention.

Following is an example how the present invention can be implemented to determine the average revolutions of an engine with respect to the distance unit when the vehicle is not equipped with a functioning odometer.

Figure 6:
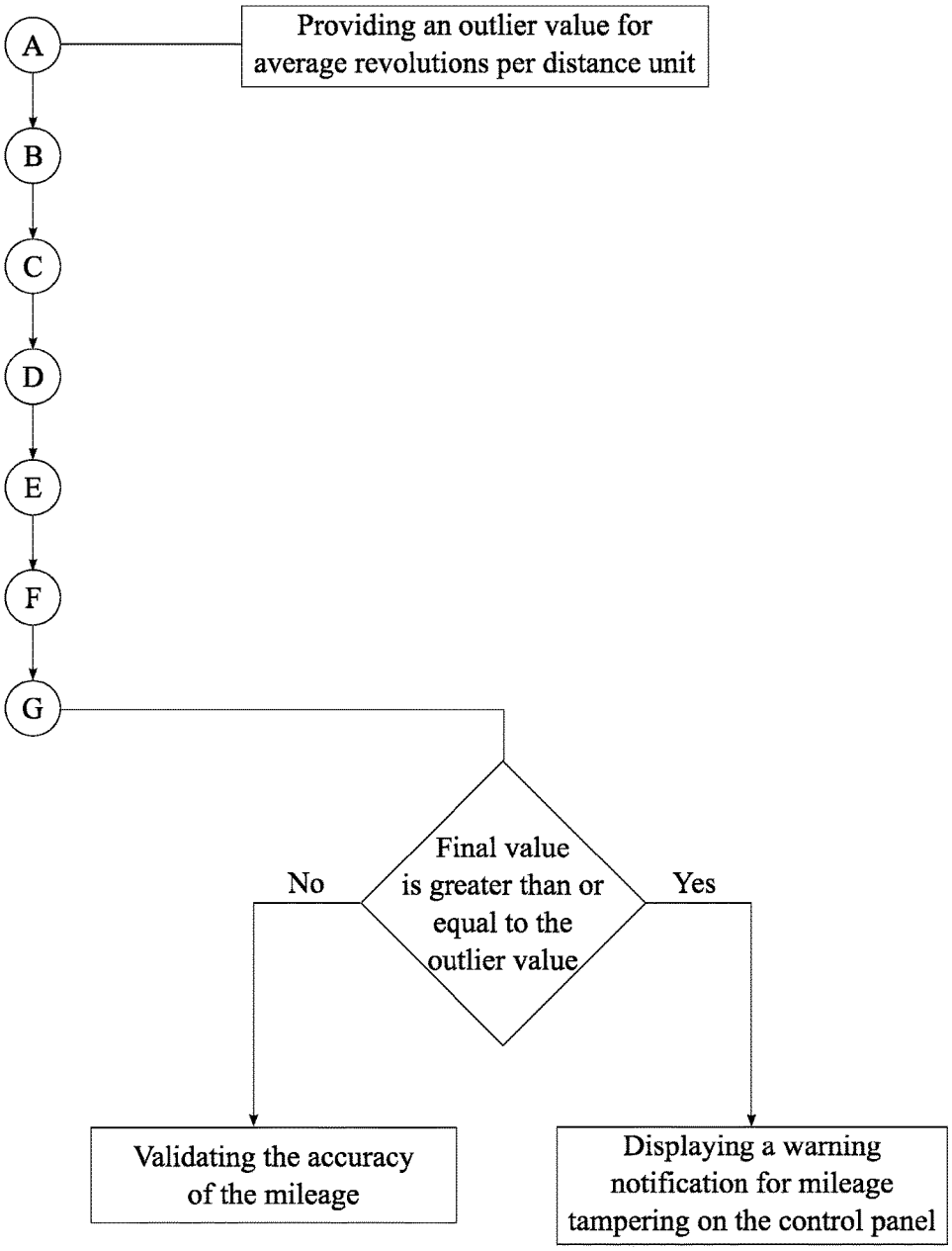
FIG. 6 is a basic flow chart illustrating how the warning notification generated within the overall method of the present invention.

- The current distance value is recorded with the retrofitted GPS unit by using incremental GPS differential changes
- Total distance=current distance recorded+sum of previous distance
- The plurality of engine revolutions is retrieved from the digital revolutions detector, wherein the revolutions can be recorded per a minute, a second, a centisecond, or a millisecond
- Total engine revolutions=current engine revolutions+sum of previous engine revolutions
- Total engine revolutions/total distance=average revolutions per distance unit In reference to FIG. 6, an outlier value of the present invention is stored within the on-board computing device, wherein the outlier value is slightly higher than the maximum possible final value of the present invention. The outlier value functions as a threshold value to detect any mileage tampering of the vehicle. More specifically, when the final value of the present invention is greater than or equal to the outlier value for a predetermined time period, the on-board computing device determines that the mileage of the vehicle is compromised. The predetermined time period is defined within the on-board computing device so that the on-board computing device is easily able to retrieve the predetermined time period for the calculation of the final value. Then a warning notification for the mileage tampering is displayed on the control panel, wherein the warning notification only provides a visual notification to the user of the vehicle. For example, if the present invention detects that the plurality of engine revolutions has occurred and the current distance value has not been changed in relation to the outlier value for the predetermined time period, the warning notification is displayed with the control panel. The on-board computing device applies the same process in order to validate the accuracy of the mileage through the present invention. More specifically, when the final value of the present invention is less than the outlier value, the on-board computing device validates the proper accuracy of the mileage. Once the warning notification is displayed through the control panel, the on-board computing device records the warning notification in order to keep track of the total number of displayed warning notifications within the present invention. For example, if an engine has displayed twenty warning notifications, the present invention records twenty different recording for each of the warning notification within the on-board computing device.

Figure 7:
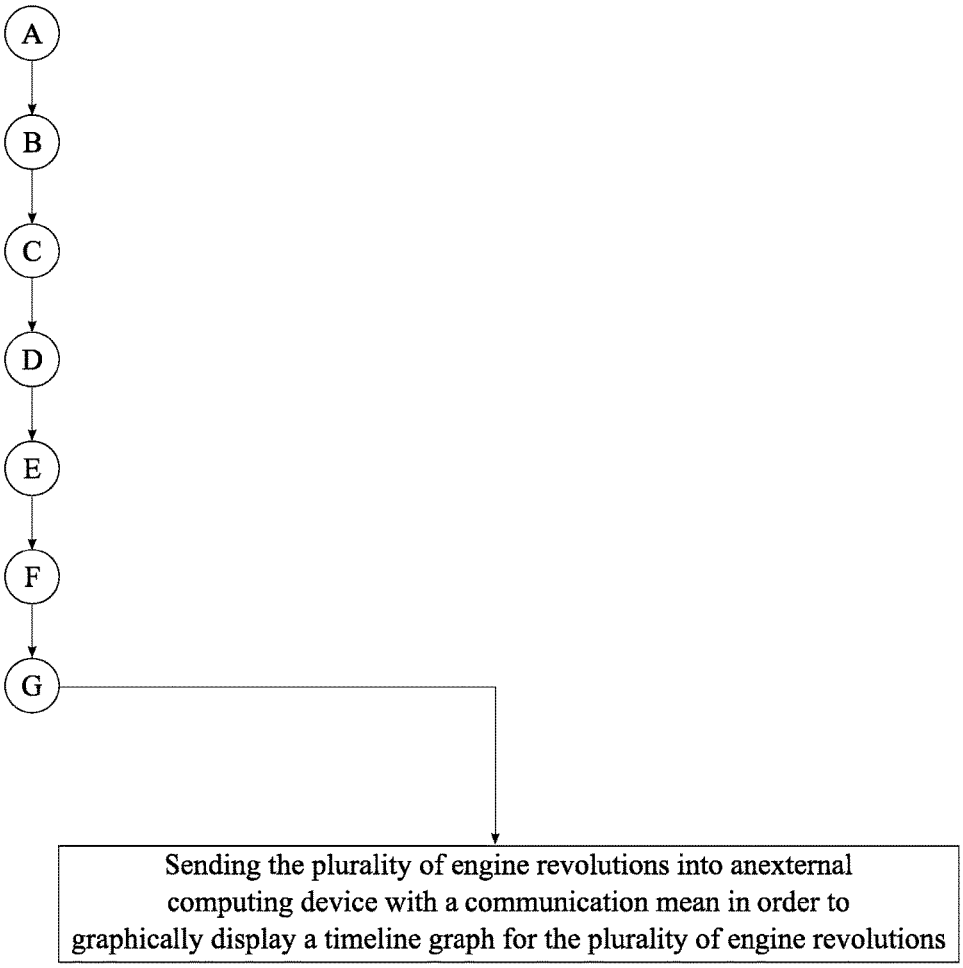
FIG. 7 is a basic flow chart illustrating how the timeline graph is created in relation to the present invention.

In reference to FIG. 7, the on-board computing device also sends the plurality of engine revolutions into an external computing device with a communication mean including, but is not limited to, an on-board diagnostic (OBD) connector, a universal serial bus (USB), a local area wireless technology, cellular network, and a wireless technology standard for exchanging data over short distances. More specifically, the plurality of engine revolutions can be exported into the computing device so that the plurality of engine revolutions can be graphically displayed on a timeline graph. As a result, the vehicle owners or the respective users are able to access the data regarding how the engine is revved by the driver of the vehicle. These data can be utilized by car manufactures, car leasing companies, insurance companies, motor vehicle departments, rental agencies, used car buyer, and any other related consumers to properly diagnose the condition of the engine and the driving style of the divers.

Although the invention has been explained in relation to its preferred embodiment, it is to be understood that many other possible modifications and variations can be made without departing from the spirit and scope of the invention as hereinafter claimed.

What is claimed is:

1. A method of calculating average revolutions per distance unit in a vehicle comprises steps of:

(A) providing an engine of the vehicle, wherein the engine includes a digital revolutions detector and an on-board computing device, and providing an outlier value for average revolutions per the distance unit;

(B) detecting a plurality of engine revolutions with the digital revolutions detector for a designated time period, and providing the designated time period as lifetime of the engine;

(C) sending, timestamping, and recording each of the engine revolutions with the on-board computing device;

(D) counting the plurality of engine revolutions with the on-board computing device in order to determine a total number of engine revolutions;

(E) retrieving a current distance value from the on-board computing device during the designated time period, wherein the on-board computing device receives the current distance value from a retrofitted global positioning system unit;

(F) calculating a final value for average revolutions per the distance unit with the on-board computing device by dividing the total number of engine revolutions with the current distance value; and (G) sending and displaying the final value with a control panel of the vehicle, and permanently recording the final value for the lifetime of the engine with the on-board computing device; and displaying a warning notification for mileage tampering on the control panel, when the final value is greater than or equal to the outlier value for a predetermined time period.

2. The method as claimed in claim 1 comprises the steps of:

sending the plurality of engine revolutions into an external computing device with a communication mean in order to graphically display a timeline graph for the plurality of engine revolutions.

3. The method as claimed in claim 1 comprises the steps of:

further providing the designated time period as a trip time;

receiving a user's start point for the designated time period through the control panel; and temporally recording the final value for the trip time with the on-board computing device.

4. The method as claimed in claim 1 comprises, wherein the current distance value being the distance unit for the engine.

5. The method as claimed in claim 1 comprises, wherein the current distance value being a time unit for the engine.

6. The method as claimed in claim 1 comprises, wherein the on-board computing device is an engine control unit.

* * * * *